US009964923B1

(12) United States Patent
Miyazaki

(10) Patent No.: US 9,964,923 B1
(45) Date of Patent: May 8, 2018

(54) IMAGE FORMING APPARATUS AND CONTROL METHOD FOR IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yasunari Miyazaki, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/826,863

(22) Filed: Nov. 30, 2017

Related U.S. Application Data

(63) Continuation of application No. 15/466,051, filed on Mar. 22, 2017.

(30) Foreign Application Priority Data

Feb. 15, 2017 (JP) ..... 2017-026395

(51) Int. Cl.
*G03G 21/20* (2006.01)
*G03G 15/00* (2006.01)

(52) U.S. Cl.
CPC ..... *G03G 21/203* (2013.01); *G03G 15/5033* (2013.01); *G03G 15/5045* (2013.01); *G03G 21/20* (2013.01)

(58) Field of Classification Search
CPC .. G03G 21/203; G03G 21/20; G03G 15/5033; G03G 15/5045
USPC ..... 399/44
See application file for complete search history.

(56) References Cited

U.S. PATENT DOCUMENTS

| | | | | |
|---|---|---|---|---|
| 5,887,220 | A | 3/1999 | Nagaoka | |
| 6,681,084 | B1 | 1/2004 | Reijnders | |
| 2004/0101322 | A1 * | 5/2004 | Tsukida | G03G 15/0856 399/27 |

FOREIGN PATENT DOCUMENTS

| | | |
|---|---|---|
| JP | 08-334981 | 12/1996 |
| JP | 2004-245940 | 9/2004 |

* cited by examiner

*Primary Examiner* — Billy Lactaoen
(74) *Attorney, Agent, or Firm* — Amin, Turocy & Watson LLP

(57) ABSTRACT

According to one embodiment, an estimation unit corrects ambient temperatures or ambient humidities measured by an environment measurement unit on the basis of calculating an estimated temperature or humidity from measured temperatures or humidities and temperature correction values or humidity correction values, so as to estimate ambient temperatures or ambient humidities of other photoconductors of which the ambient temperatures or the ambient humidities are not measured. A control unit determines image formation conditions for the image forming units forming images on the photoconductors of which the ambient temperatures or the ambient humidities are not measured, on the basis of the ambient temperatures or the ambient humidities estimated by the estimation unit.

9 Claims, 6 Drawing Sheets

FIG. 6

| RESISTANCE VALUE RANGE | TEMPERATURE CORRECTION VALUE ΔT |
|---|---|
| R > RL10 | 20 |
| RH10 ≧ R > RH9 | 18 |
| RH9 ≧ R > RH8 | 16 |
| RH8 ≧ R > RH7 | 14 |
| RH7 ≧ R > RH6 | 12 |
| RH6 ≧ R > RH5 | 10 |
| RH5 ≧ R > RH4 | 8 |
| RH4 ≧ R > RH3 | 6 |
| RH3 ≧ R > RH2 | 4 |
| RH2 ≧ R > RH1 | 2 |
| RH1 ≧ R ≧ RL1 | 0 |
| RL1 > R ≧ RL2 | -2 |
| RL2 > R ≧ RL3 | -4 |
| RL3 > R ≧ RL4 | -6 |
| RL4 > R ≧ RL5 | -8 |
| RL5 > R ≧ RL6 | -10 |
| RL6 > R ≧ RL7 | -12 |
| RL7 > R ≧ RL8 | -14 |
| RL8 > R ≧ RL9 | -16 |
| RL9 > R ≧ RL10 | -18 |
| RL10 > R | -20 |

IMAGE FORMING APPARATUS AND CONTROL METHOD FOR IMAGE FORMING APPARATUS

CROSS-REFERENCE TO RELATED APPLICATIONS

This application is a Continuation of application Ser. No. 15/466,051 filed on Mar. 22, 2017, the entire contents of which are incorporated herein by reference.

This application is based upon and claims the benefit of priority from Japanese Patent Application No. 2017-026395, filed Feb. 15, 2017, the entire contents of which are incorporated herein by reference.

FIELD

Embodiments described herein relate to an image forming apparatus and a control method for the image forming apparatus.

BACKGROUND

An electrophotographic image forming apparatus is provided with an environmental sensor which detects temperature or humidity of the vicinity of a photoconductor surface. Image formation conditions such as a voltage applied to a charging roller are determined on the basis of information indicating an ambient temperature or an environmental humidity of a photoconductor, detected by the environmental sensor.

If an image forming apparatus includes a plurality of photoconductors, an environmental sensor is preferably provided in each of all of the photoconductors. However, it is desired to reduce the number of environmental sensors from the viewpoint of reducing cost. In this case, in the image forming apparatus, an ambient temperature of a photoconductor having the environmental sensor is used instead of an ambient temperature of a photoconductor not having the environmental sensor.

However, actually, there are many cases where there is a difference between an ambient temperature of a photoconductor having the environmental sensor and an ambient temperature of a photoconductor not having the environmental sensor. In this case, a charging state of a charging roller with respect to the photoconductor not having the environmental sensor is insufficient or excessive, and thus there is a probability that the quality of a formed image deteriorates.

DESCRIPTION OF THE DRAWINGS

FIG. 6 is a diagram illustrating a specific example of a setting information table.

DETAILED DESCRIPTION

An object of exemplary embodiments is to provide an image forming apparatus and a control method for the image forming apparatus, capable of controlling an ambient temperature of a photoconductor not having an environmental sensor with higher accuracy.

In general, according to one embodiment, there is providing an image forming apparatus including an environment measurement unit, one or more image forming units, an estimation unit, and a control unit. The environment measurement unit measures ambient temperatures or ambient humidities of some photoconductors among a plurality of photoconductors. The one or more image forming units form images on the plurality of photoconductors. The estimation unit corrects the ambient temperatures or the ambient humidities measured by the environment measurement unit on the basis of conduction states of charging members provided in the one or more image forming units, so as to estimate ambient temperatures or ambient humidities of other photoconductors of which the ambient temperatures or the ambient humidities are not measured. The control unit determines image formation conditions for the image forming units forming images on the photoconductors of which the ambient temperatures or the ambient humidities are not measured, on the basis of the ambient temperatures or the ambient humidities estimated by the estimation unit.

Hereinafter, with reference to the drawings, a description will be made of an image forming apparatus and a control method for the image forming apparatus of an embodiment.

Figure 1:
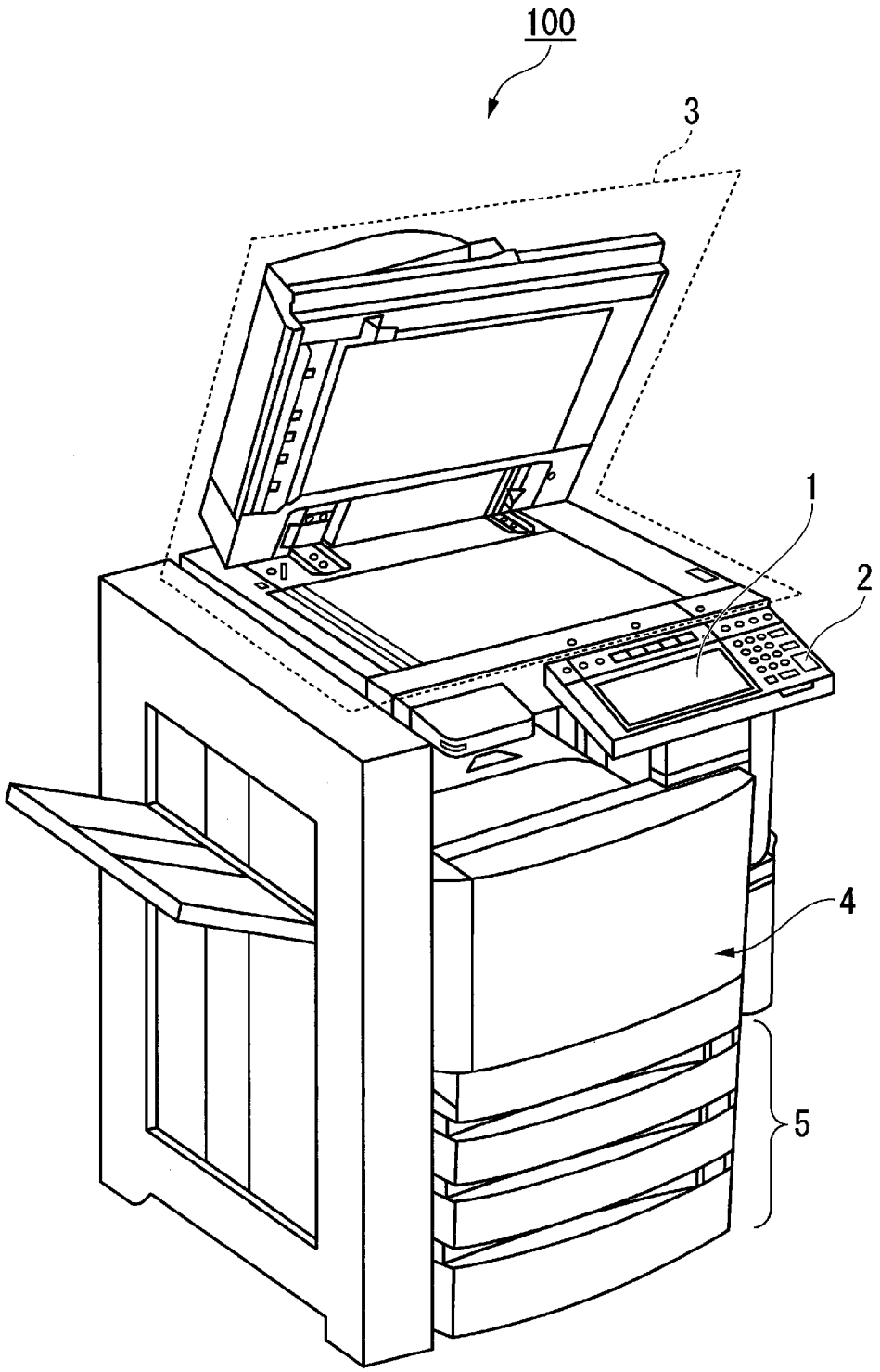
FIG. 1 is an exterior diagram illustrating the entire configuration example of an image forming apparatus in the present embodiment.

FIG. 1 is an exterior diagram illustrating the entire configuration example of an image forming apparatus 100 of the present embodiment. The image forming apparatus 100 is, for example, a multifunction peripheral. The image forming apparatus 100 includes a display 1, a control panel 2, an image reading unit 3, a printer unit 4, and a sheet accommodation unit 5. The image forming apparatus 100 forms an image on a sheet by using a developer such as toner. The sheet is, for example, paper or a label paper sheet. The sheet may be any object as long as the image forming apparatus 100 can form an image on a surface of the sheet.

The display 1 is an image display device such as a liquid crystal display or an organic electroluminescence (EL) display. The display 1 displays various pieces of information regarding the image forming apparatus 100.

The control panel 2 has a plurality of buttons. The control panel 2 receives a user's operation. The control panel 2 outputs a signal corresponding to an operation performed by the user to a control unit of the image forming apparatus 100. The display 1 and the control panel 2 may be formed as an integral touch panel.

The image reading unit 3 reads image information of a reading target as the brightness of light. The image reading unit 3 records the read image information. The recorded image information may be transmitted to other information processing apparatuses via a network. The recorded image information may be formed as an image on a sheet by the printer unit 4.

The printer unit 4 forms an image on a sheet on the basis of image information generated by the image reading unit 3 or image information received via a communication path. The printer unit 4 forms an image, for example, through the following process. An image forming portion of the printer unit 4 forms an electrostatic latent image on a photoconductive drum on the basis of image information. The image forming portion of the printer unit 4 forms a visible image by attaching a developer to the electrostatic latent image. Toner is a specific example of the developer. A transfer portion of the printer unit 4 transfers the visible image onto a sheet. A fixing portion of the printer unit 4 fixes the visible image to the sheet by heating and pressing the sheet. The sheet on which an image is formed may be a sheet accommodated in the sheet accommodation unit 5, and may be a sheet pointed by a hand.

The sheet accommodation unit 5 accommodates sheets used for forming an image in the printer unit 4.

Figure 2:
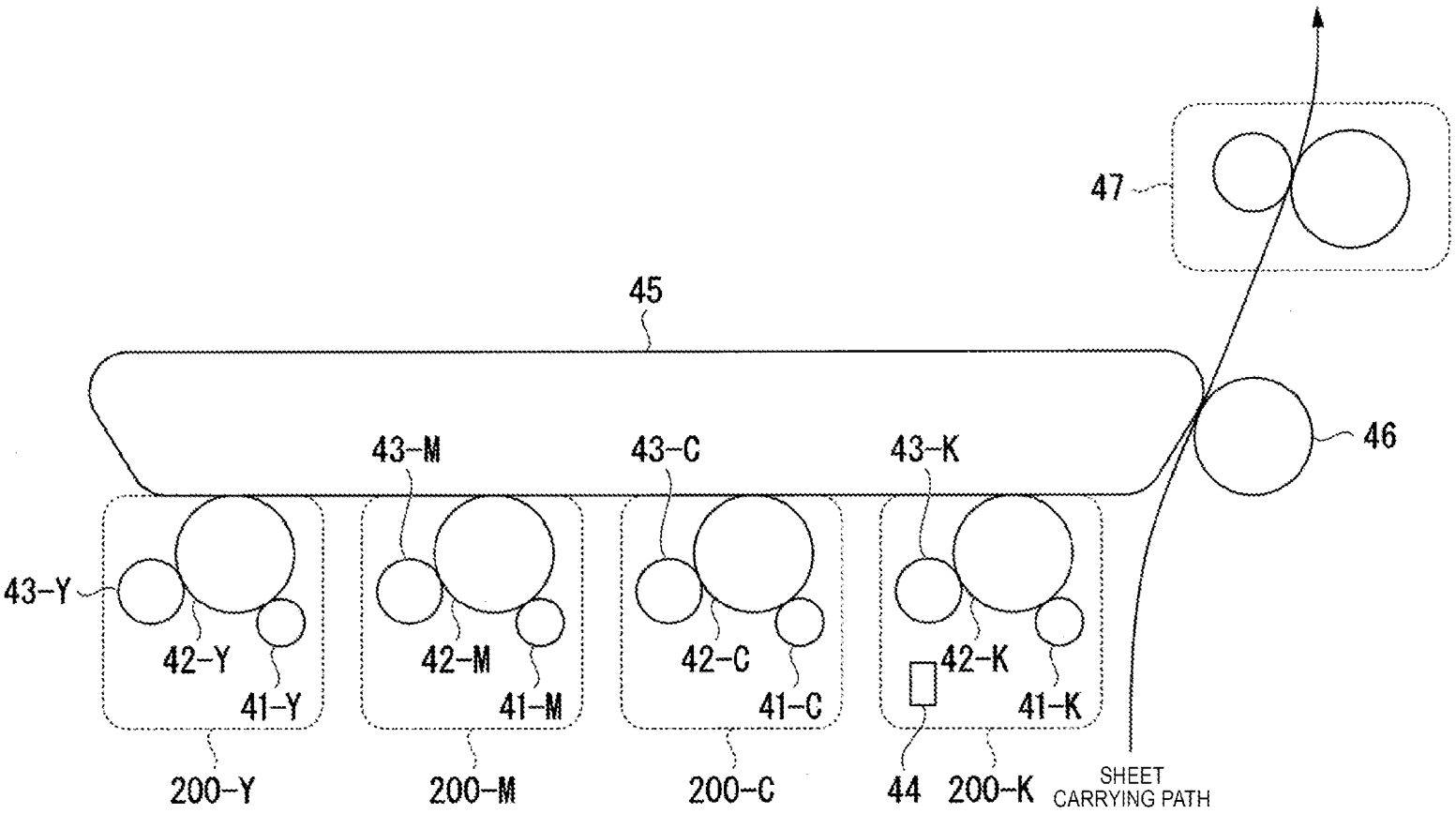
FIG. 2 is a diagram illustrating a specific example of a configuration regarding an image forming process in a printer unit.

FIG. 2 is a diagram illustrating a specific example of a configuration regarding an image formation process in the printer unit 4 in the present embodiment. The printer unit 4 includes, as a configuration regarding the image formation process, a charging roller 41, a photoconductive drum 42, a development device 43, a temperature detection sensor 44, a transfer belt 45, a secondary transfer roller 46, and a fixing device 47. Among the above-described functional portions, the charging roller 41, the photoconductive drum 42, and the development device 43 are provided for respective toner colors such as yellow (Y), magenta (M), cyan (C), and black (K). Hereinafter, the functional portions provided for the respective toner colors will be collectively referred to as a station. Hereinafter, the functional portions of each station are differentiated from each other by adding "Y", "M", "C", or "K" to reference numerals of the functional portions. The temperature detection sensor 44 (an example of an ambient temperature measurement unit) is provided in only the station 200-K corresponding to black (K) among the stations 200 corresponding to the respective toner colors.

Generally, the image formation process is mainly divided into processes such as charging, exposure, development, transfer, and fixation. In the charging process, the charging roller 41 (an example of a charging member) negatively charges a surface of the photoconductive drum 42. In the exposure process, the negatively charged surface of the photoconductive drum 42 is irradiated with laser light, and a latent image is formed thereon. In the development process, the development device 43 attaches toner to the surface of the photoconductive drum 42. In the transfer process, an image is formed on a sheet which is an image forming target. Specifically, the toner image is transferred onto the transfer belt 45 from the photoconductive drum 42 of each station (primary transfer), and the toner image on the transfer belt 45 is transferred onto the sheet by the secondary transfer roller 46 (secondary transfer). In the fixation process, the fixing device 47 fixes the toner image transferred onto the sheet to the sheet.

In this image formation process, the temperature detection sensor 44 is used to control a potential of the surface of the photoconductive drum 42. Generally, an organic photoconductor (OPC) has temperature dependency. Thus, generally, an image forming apparatus is provided with a temperature detection sensor measuring an ambient temperature of a photoconductive drum, and controls a surface potential of the photoconductive drum by controlling a voltage applied to a charging roller on the basis of the ambient temperature of the photoconductive drum measured by the temperature detection sensor.

However, in an image forming apparatus including a plurality of stations, the temperature detection sensor is provided in some of the stations inmost cases. In the example illustrated in FIG. 2, among the four stations 200, the temperature detection sensor 44 is provided in the station 200-K corresponding to black (K). Thus, in the related art, a surface potential of a photoconductive drum of a station not having the temperature detection sensor is controlled on the basis of an ambient temperature of a photoconductive drum of a station having the temperature detection sensor. However, ambient temperatures of the photoconductive drums of the respective stations are not necessarily the same as each other. Thus, in a control method of the related art, there is a probability that a surface potential of the photoconductive drum may not be appropriately controlled.

Figure 3:
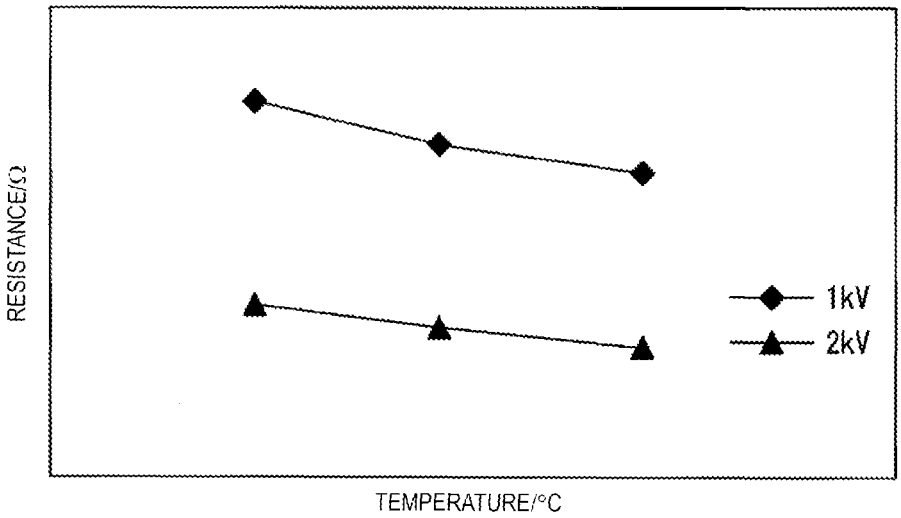
FIG. 3 is a diagram illustrating an example of temperature dependency of a resistance value of a charging roller.
Figure 4:
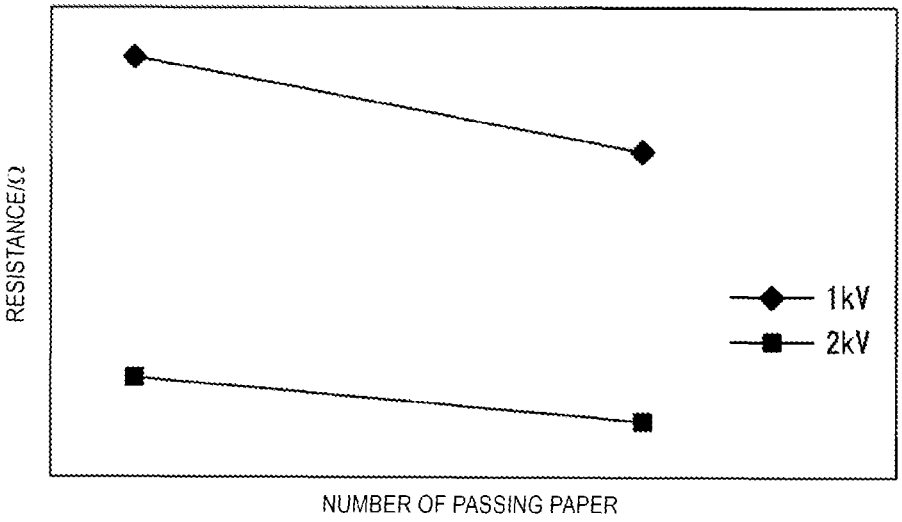
FIG. 4 is a diagram illustrating an example of life dependency of a resistance value.

FIG. 3 is a diagram illustrating an example of temperature dependency of a resistance value of the charging roller in the present embodiment. In FIG. 3, a transverse axis expresses a temperature, and a longitudinal axis expresses a resistance value of the charging roller. FIG. 3 illustrates that a resistance value of the charging roller also changes depending on a temperature due to temperature dependency of a photoconductor on the surface of the photoconductive drum. FIG. 4 is a diagram illustrating an example of life dependency of a resistance value of the charging roller in the present embodiment. The term "life" indicates a deterioration of the photoconductive drum or the extent of the deterioration. The life progresses due to an increase in the number of passing paper, the number of rotations of the photoconductive drum, operation time, or the like. In FIG. 4, a transverse axis expresses the number of passing paper as an example of the life, and a longitudinal axis expresses a resistance value of the charging roller. FIG. 4 illustrates that a resistance value of the charging roller is reduced according to an increase in the number of passing paper.

A resistance value of the charging roller changes depending on a deterioration of the charging roller or a deterioration of the photoconductive drum. If the life progresses, a film thickness of the photoconductive drum surface is reduced, and a photoconductive layer itself is also deteriorated. By taking into consideration this fact, the image forming apparatus 100 of the present embodiment includes a control unit 48 described below, and can thus control a surface potential of the photoconductive drum more appropriately.

Figure 5:
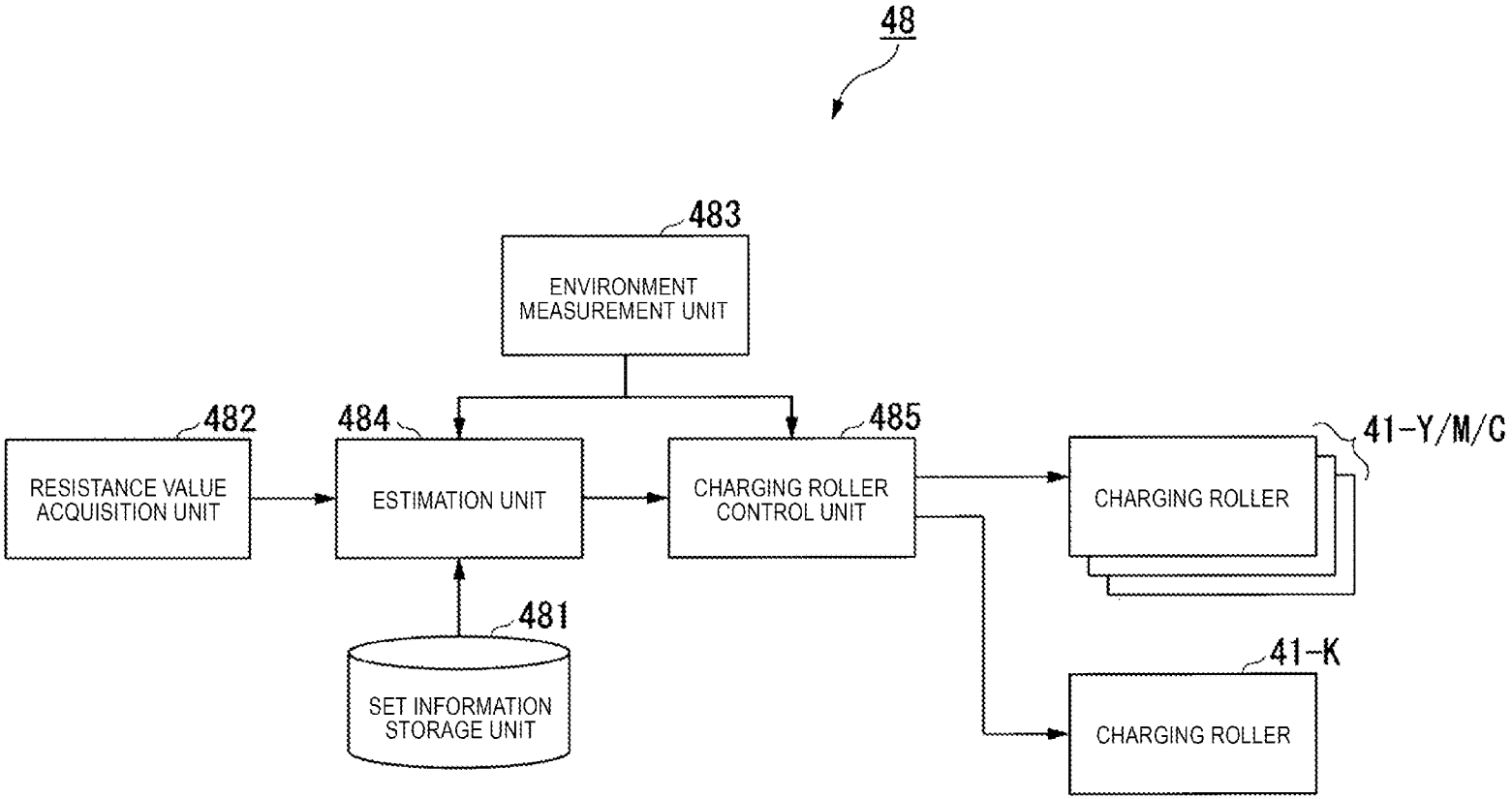
FIG. 5 is a block diagram illustrating a specific example of a functional configuration of a control unit.

FIG. 5 is a block diagram illustrating a specific example of a functional configuration of the control unit 48 in the present embodiment. The control unit 48 includes a central processing unit (CPU), a memory, an auxiliary storage device, and the like, connected to each other via a bus, and executes a control program. The control unit 48 functions as a setting information storage unit 481, a resistance value acquisition unit 482, an environment measurement unit 483, an estimation unit 484, and a charging roller control unit 485 by executing the control program. The control unit 48 determines image formation conditions for the printer unit 4 (an example of an image forming unit) forming an image on a photoconductor whose ambient temperature or ambient humidity is not measured on the basis of an estimated ambient temperature or ambient humidity.

The setting information storage unit 481 is formed of a storage device such as a magnetic hard disk device or a semiconductor storage device. The setting information storage unit 481 stores various pieces of setting information which are required to control a surface potential of the photoconductive drum 42.

The resistance value acquisition unit 482 acquires information (hereinafter, referred to as "resistance value information") indicating a resistance value (an example of a conduction state) of the charging roller. Specifically, the resistance value acquisition unit 482 applies a constant voltage to each charging roller 41, and measures an amount of current which flows due to the application of the voltage.

The resistance value acquisition unit 482 calculates a resistance value of each charging roller 41 on the basis of the applied voltage and a measured current amount, so as to acquire the resistance value information. The resistance value acquisition unit 482 outputs the acquired resistance value information to the estimation unit 484.

The environment measurement unit 483 acquires information (hereinafter, referred to as "ambient temperature information") indicating the ambient temperature of a photoconductive drum of a station including the temperature detection sensor. Specifically, the environment measurement unit 483 acquires the ambient temperature information of the photoconductive drum 42-K of the station 200-K corresponding to black (K) from the temperature detection sensor 44. The environment measurement unit 483 outputs the acquired ambient temperature information to the estimation unit 484.

The estimation unit 484 estimates the ambient temperature of a photoconductive drum whose ambient temperature is not measured on the basis of the setting information, the acquired resistance value information, and the acquired ambient temperature information. Specifically, the estimation unit 484 estimates ambient temperatures of the photoconductive drums 42 (Y, M, C). Hereinafter, an ambient temperature of the photoconductive drum 42 (K) whose ambient temperature is measured will be referred to as a measured temperature, and ambient temperatures estimated with respect to the photoconductive drums 42 (Y, M, C) whose ambient temperatures are not measured will be referred to as estimated temperatures. In other words, in the present embodiment, an ambient temperature of the photoconductive drum 42-K is a measured temperature, and ambient temperatures of the photoconductive drums 42-Y, 42-M and 42-C are estimated temperatures. The estimated temperatures are acquired by correcting the measured temperature with a correction value which is determined on the basis of the setting information, the resistance value information, and the ambient temperature information. The estimation unit 484 outputs information (hereinafter, referred to as "estimated temperature information") indicating the estimated temperatures to the charging roller control unit 485.

The charging roller control unit 485 determines voltages (an example of the image formation conditions) applied to the respective charging rollers 41-Y, 41-M and 41-C on the basis of the ambient temperature information and the estimated temperature information. Specifically, the charging roller control unit 485 determines a voltage applied to the charging roller 41-K on the basis of the ambient temperature information, and determines voltages applied to the charging rollers 41-Y, 41-M and 41-C on the basis of the estimated temperature information.

The charging roller control unit 485 applies the determined application voltages to the respective charging rollers 41 so as to control surface potentials of the respective photoconductive drums 42.

FIG. 6 is a diagram illustrating a specific example of a setting information table in the present embodiment. For example, the setting information table has a temperature correction value for each range (resistance value range) of a resistance value R of each charging roller 41. The temperature correction value indicates a correction value of an ambient temperature for a measured temperature in a case where the resistance value R of the charging roller is included in a corresponding resistance value range. Here, the resistance range value is obtained by taking into consideration the following description. A resistance value of the charging roller changes depending on a life or a temperature environment as described above. Therefore, a resistance value (this is referred to as a standard resistance value) of the charging roller in which a life or a temperature change is taken into consideration is obtained in advance by using two coefficients f(a) and f(b) with respect to the charging roller having an initial resistance value R0. Here, f(a) is a coefficient (hereinafter, referred to as a "life coefficient") indicating the degree of progress of a life, and f(b) is a coefficient (hereinafter, referred to as a "temperature coefficient") indicating temperature dependency. The standard resistance value takes values such as RLn (where n=1, 2, . . . , and 10) and RHn (where n=1, 2, . . . , and 10), and satisfies the following Expressions (1) and (2)

$$RHn<RHn+1 \quad (1)$$

$$RLn>RLn+1 \quad (2)$$

In this case, if the resistance value R is smaller than RL1, the estimation unit 484 corrects the measured temperature by using a negative value in ten stages according to the magnitude of the resistance value R. If the resistance value R is greater than RH1, the estimation unit 484 corrects the measured temperature by using a positive value in ten stages according to the magnitude of the resistance value R. If the resistance value R is equal to or greater than RL1 and equal to or smaller than RH1, the estimation unit 484 does not correct the measured temperature. In this case, if the measured temperature is indicated by T0, and each temperature correction value corresponding to the resistance value R is indicated by ΔT, the estimation unit 484 calculates an estimated temperature T according to the following Equation (3).

$$T=T0+\Delta T \quad (3)$$

The setting information may be stored as information indicating equations for estimating temperatures in addition to the above-described setting information table. For example, if the estimated temperature T is proportional to the resistance value R, information indicating the following Equation (4) may be stored as the setting information.

$$T=\beta\times R+c \quad (4)$$

In Equation (4), β indicates a coefficient of the resistance value R, and c indicates an intercept. In addition, β and c may be defined as functions of the life coefficient, the temperature coefficient, or a measured temperature.

Figure 7:
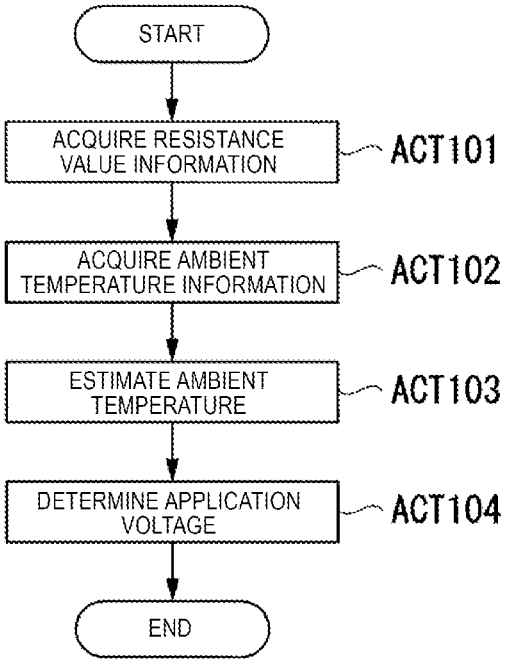
FIG. 7 is a flowchart illustrating a flow of a process in which the image forming apparatus controls a surface potential of a photoconductive drum.

FIG. 7 is a flowchart illustrating a flow of a process in which the image forming apparatus 100 of the present embodiment controls a surface potential of the photoconductive drum 42. First, the resistance value acquisition unit 482 acquires resistance value information of each charging roller 41 (ACT 101). The resistance value acquisition unit 482 outputs the acquired resistance value information to the estimation unit 484. On the other hand, the environment measurement unit 483 acquires ambient temperature information of the photoconductive drum 42 (K) of the station having the temperature detection sensor 44 (ACT 102). The environment measurement unit 483 outputs the acquired ambient temperature information to the estimation unit 484.

Next, the estimation unit 484 estimates the ambient temperatures of the photoconductive drums 42 (Y, M, C) whose ambient temperatures are not measured on the basis of measured resistance value information and the setting information stored in the setting information storage unit (ACT 103). Specifically, the estimation unit 484 determines a correction value for an ambient temperature on the basis of the setting information and the resistance value information, and acquires an estimated temperature by correcting the measured ambient temperature with the determined correction value.

For example, if the measured resistance value R satisfies RL1>R≥RL2, the estimation unit 484 selects a setting information record having RL1>R≥RL2 in the resistance value range by referring to the setting information table. The estimation unit 484 acquires "−2" as a temperature correction value from the selected setting information record. The estimation unit 484 acquires an estimated temperature by adding the acquired temperature correction value of "−2 (° C.)" to the measured temperature. The estimation unit 484 outputs the estimated temperature information acquired in the above-described way to the charging roller control unit 485.

The estimation unit 484 may estimate an ambient temperature by using setting information common to the photoconductive drums 42 (Y, M, C) whose ambient temperatures are not measured, and may estimate an ambient temperature of each of the photoconductive drums 42 (Y, M, C) whose ambient temperatures are not measured by using setting information regarding each of the photoconductive drums 42 (Y, M, C) whose ambient temperatures are not measured.

The charging roller control unit 485 determines a voltage applied to the charging roller 41 on the basis of the estimated temperature information (ACT 104). Specifically, the charging roller control unit 485 determines voltages applied to the charging rollers 41-Y, 41-M and 41-C respectively charging the photoconductive drums 42-Y, 42-M and 42-C. For example, if a formula for calculating an application voltage is indicated by f, f is given on the basis of a charging potential V0 on a photoconductor and an exposure potential VL on the photoconductor. Both of the charging potential V0 and the exposure potential VL change depending on the ambient temperature of the photoconductive drum 42. Thus, f may be expressed as in the following Equation (5) by using the estimated temperature T.

$$f(T)=F\{V0(T),VL(T)\} \quad (5)$$

The charging roller control unit 485 applies the application voltage calculated in the above-described way to each charging roller 41. The ambient temperature of each of the photoconductive drums 42 (Y, M, C) is controlled to be set to the estimated temperature, and thus the image forming apparatus 100 can also control a surface potential of the photoconductive drum 42 to be set to an appropriate potential according to the progress of life with respect to the station 200 not having the temperature detection sensor 44.

The image forming apparatus 100 of the embodiment configured in the above-described way can determine a voltage applied to the charging roller according to a life progress situation of a photoconductor. Thus, the image forming apparatus of the embodiment can more appropriately control a voltage applied to the charging roller even if each photoconductive drum is not provided with a mechanism measuring an ambient temperature.

For example, an image forming apparatus is assumed which includes black, yellow, magenta, and cyan stations, and in which a temperature measurement unit is provided in only the black station. In this case, in the related art, yellow, magenta, and cyan photoconductive drums are controlled on the basis of an ambient temperature of a black photoconductive drum. However, life progress situations of the respective stations may be different from each other. Generally, there is a high probability that the image forming apparatus may perform an image formation process by using black toner, a life tends to easily progress in the black station 200-K. Thus, in a control method of the related art, there may be a difference between a temperature to be controlled and an actual ambient temperature in the yellow, magenta and cyan photoconductive drums. This difference may lead to a difference between a voltage applied to a charging roller and an actually necessary voltage value.

According to at least one embodiment described above, there are provided an estimation unit that corrects an ambient temperature or an ambient humidity measured by an environment measurement unit on the basis of conduction states of charging members provided in one or more image forming units, so as to estimate ambient temperatures or ambient humidities of other photoconductors whose ambient temperatures or ambient humidities are not measured, and a control unit that determines image formation conditions for the charging members forming images on the photoconductors whose ambient temperatures or ambient humidities are not measured on the basis of the ambient temperatures or the ambient humidities estimated by the estimation unit. Therefore, an ambient temperature of the photoconductive drum can be estimated with higher accuracy. As a result, a control potential of the charging roller charging the photoconductive drum can be controlled more appropriately.

In the image forming apparatus 100 of the embodiment, a temperature detection sensor is not necessarily required to be provided in a single photoconductive drum. For example, the image forming apparatus 100 may include a total of two temperature detection sensors including a single temperature detection sensor provided in the black station 200-K, and a single temperature detection sensor provided in any one of the other color stations 200-Y, 200-M and 200-C, or temperature detection sensors provided in all of the stations 200. In this case, the image forming apparatus 100 may control a voltage applied to the charging roller 41 by using any one of ambient temperatures measured by the respective temperature detection sensors. In this case, the image forming apparatus 100 may control a voltage applied to the charging roller 41 on the basis of a statistical value such as an average value, the maximum value, or the minimum value of the ambient temperatures. With this configuration, ambient temperatures of the photoconductive drums 42-Y, 42-M and 42-C can be corrected with higher accuracy.

In the above-described embodiment, a description has been made of an example in which a voltage applied to the charging roller 41 is controlled by using the temperature detection sensor 44, but the image forming apparatus 100 may include a humidity detection sensor measuring an ambient humidity of the photoconductor instead of the temperature detection sensor 44, and may determine a voltage applied to the charging roller 41 by correcting the humidity. A control target may be a development bias voltage supplied to the development device 43.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an environment measurement unit that measures ambient temperatures or ambient humidities of some photoconductors among a plurality of photoconductors;

one or more image forming units that form images on the plurality of photoconductors;

an estimation unit that corrects the ambient temperatures or the ambient humidities measured by the environment measurement unit on the basis of calculating an estimated temperature or humidity from measured temperatures or humidities and temperature correction values or humidity correction values, so as to estimate ambient temperatures or ambient humidities of other photoconductors of which the ambient temperatures or the ambient humidities are not measured; and a control unit that determines image formation conditions for the image forming units forming images on the photoconductors of which the ambient temperatures or the ambient humidities are not measured, on the basis of the ambient temperatures or the ambient humidities estimated by the estimation unit.

2. The apparatus according to claim 1, further comprising:

a resistance measurement unit that measures resistance values of the charging members, wherein the estimation unit determines correction values for the ambient temperatures or the ambient humidities on the basis of the resistance values of the charging members, measured by the resistance measurement unit.

3. The apparatus according to claim 2, wherein the estimation unit determines the correction values for the ambient temperatures on the basis of the resistance values of the charging members measured by the resistance measurement unit, and setting information which is determined according to the degree of deterioration of the photoconductors and indicates correspondence relationships between the correction values and the measured resistance values.

4. The apparatus according to claim 1, wherein the plurality of photoconductors are at least one photoconductor for color output and a black photoconductor, and wherein the environment measurement unit is provided in the black photoconductor.

5. The apparatus according to claim 1, wherein calculating the estimated temperature comprises using the following Equation (3)

$$T=T0+\Delta T \quad (3)$$

where measured temperature is indicated by T0, and each temperature correction value corresponding to a resistance value R is indicated by ΔT, and T is the estimated temperature T.

6. The apparatus according to claim 1, wherein calculating the estimated temperature comprises using the following Equation (4)

$$T=\beta\times R+c \quad (4)$$

where β indicates a coefficient of the resistance value R, c indicates an intercept, and T is the estimated temperature T.

7. A control method for an image forming apparatus, the method comprising:

measuring ambient temperatures or ambient humidities of some photoconductors among a plurality of photoconductors;

correcting the measured ambient temperatures or the ambient humidities on the basis of calculating an estimated temperature or humidity from measured temperatures or humidities and temperature correction values or humidity correction values, so as to estimate ambient temperatures or ambient humidities of other photoconductors of which the ambient temperatures or the ambient humidities are not measured; and changing image formation conditions for the image forming units forming images on the photoconductors of which the ambient temperatures or the ambient humidities are not measured, on the basis of the estimated ambient temperatures or the estimated ambient humidities.

8. The method according to claim 7, wherein calculating the estimated temperature comprises using the following Equation (3)

$$T=T0+\Delta T \quad (3)$$

where measured temperature is indicated by T0, and each temperature correction value corresponding to a resistance value R is indicated by ΔT, and T is the estimated temperature T.

9. The method according to claim 7, wherein calculating the estimated temperature comprises using the following Equation (4)

$$T=\beta\times R+c \quad (4)$$

where β indicates a coefficient of the resistance value R, c indicates an intercept, and T is the estimated temperature T.

* * * * *